US006897617B2

(12) United States Patent
Lee

(10) Patent No.: US 6,897,617 B2
(45) Date of Patent: May 24, 2005

(54) METHOD AND APPARATUS TO REDUCE OZONE PRODUCTION IN ION WIND DEVICE

(75) Inventor: Jim L. Lee, Rohnert Park, CA (US)

(73) Assignee: Zenion Industries, Inc., Rohnert Park, CA (US)

( * ) Notice: Subject to any disclaimer, the term of this patent is extended or adjusted under 35 U.S.C. 154(b) by 0 days.

(21) Appl. No.: 10/168,723

(22) PCT Filed: Dec. 22, 2000

(86) PCT No.: PCT/US00/35401

§ 371 (c)(1),
(2), (4) Date: Jun. 21, 2002

(87) PCT Pub. No.: WO01/47803

PCT Pub. Date: Jul. 5, 2001

(65) Prior Publication Data

US 2002/0190658 A1 Dec. 19, 2002

Related U.S. Application Data

(60) Provisional application No. 60/173,075, filed on Dec. 24, 1999.

(51) Int. Cl.[7] ..... H05B 31/26; H01J 7/24

(52) U.S. Cl. ..... 315/111.81; 315/111.91; 315/111.21; 315/111.61; 315/39; 315/500; 315/506; 250/423 R

(58) Field of Search ..... 315/111.81, 111.21, 315/111.91, 111.61, 39, 500, 506, 111.18, 111.51, 111.24, 10, 111–61; 250/423 R; 96/19, 65, 77, 15, 16, 18, 97; 55/385.1, 385.2; 422/186.04; 119/165, 420, 500

(56) References Cited

U.S. PATENT DOCUMENTS

| | | | | | |
|---|---|---|---|---|---|
| 4,789,801 | A | * | 12/1988 | Lee | 310/308 |
| 5,975,090 | A | | 11/1999 | Taylor et al. | |
| 6,152,146 | A | | 11/2000 | Taylor et al. | |
| 6,163,098 | A | | 12/2000 | Taylor et al. | |
| 6,176,977 | B1 | * | 1/2001 | Taylor et al. | 204/176 |
| 6,182,671 | B1 | | 2/2001 | Taylor et al. | |
| 6,312,507 | B1 | * | 11/2001 | Taylor et al. | 96/19 |
| 6,350,417 | B1 | * | 2/2002 | Lau et al. | 422/186.04 |
| 6,451,266 | B1 | | 9/2002 | Lau et al. | |
| 6,492,784 | B1 | * | 12/2002 | Serrano | 315/506 |
| 6,504,308 | B1 | * | 1/2003 | Krichtafovitch et al. | 315/110.91 |
| 6,544,485 | B1 | * | 4/2003 | Taylor | 422/186.04 |
| 6,585,935 | B1 | | 7/2003 | Taylor et al. | |
| 6,588,434 | B2 | | 7/2003 | Taylor et al. | |
| 2001/0004046 | A1 | | 6/2001 | Taylor et al. | |
| 2001/0032544 | A1 | | 10/2001 | Taylor et al. | |
| 2001/0048906 | A1 | | 12/2001 | Lau et al. | |
| 2002/0079212 | A1 | | 6/2002 | Taylor et al. | |
| 2002/0098131 | A1 | | 7/2002 | Taylor et al. | |
| 2002/0100488 | A1 | | 8/2002 | Taylor et al. | |
| 2002/0141914 | A1 | | 10/2002 | Lau et al. | |
| 2003/0072697 | A1 | | 4/2003 | Taylor | |

* cited by examiner

*Primary Examiner*—Don Wong
*Assistant Examiner*—Chuc Tran
(74) *Attorney, Agent, or Firm*—Craig M. Stainbrook; Larry D. Johnson; Johnson & Stainbrook, LLP

(57) ABSTRACT

A method to limit ozone production in wind ion devices while simultaneously realizing incidents of high acceleration in such devices varies the high voltage potential across the array of emitter(s) (10) and collectors (20) over time in such a manner as to generate a wave effect of airflow. The variance may be achieved by switching, ramping, or gating the high voltage potential delivered to the array.

24 Claims, 2 Drawing Sheets

PULSED HIGH VOLTAGE TO EMITTER / COLLECTOR ARRAY

METHOD AND APPARATUS TO REDUCE OZONE PRODUCTION IN ION WIND DEVICE

This application claims the benefit of Provisional Application Ser. No. 60/173,075, filed Dec. 24, 1999.

BACKGROUND OF THE INVENTION

1. Technical Field

This invention relates generally to ion generators and ion wind devices, and more specifically to an improved method and apparatus for reducing the production of ozone in ion wind devices.

2. Background Art

Ion wind devices such as described in Lee U.S. Pat. No. 4,789,801 (incorporated herein by reference) provide accelerated gas ions generated by the use of differential high voltage electric fields between an array of one or more emitters and a plurality of collectors (accelerators). The ions are entrained in the ambient bulk gases, causing the gases to flow. Gas velocities can reach as high as eight hundred feet per minute. However, the high voltage electric fields used to generate the gas ions and provide the force necessary for gas acceleration are also responsible for creating molecular dissociation reactions, the most common of which include ozone generated from oxygen when such devices are operating in a breathable atmosphere. It is an object of this invention to provide methods to reduce the production of ozone in such devices.

The U.S. Food and Drug Administration has determined that indoor airborne ozone in concentrations above 50 ppb (parts per billion) may be hazardous to humans. NIOSH has ruled that indoor concentrations of ozone above 100 ppb may be hazardous to humans. Devices which utilize high voltage electric fields to generate atmospheric plasma, corona discharge and air ions are all susceptible to generating the allotrope, ozone. There exists a linear relationship between the level of the high voltage fields and current and the level of ozone concentration in most direct current operated ion wind systems. Also, a linear relationship exists between the acceleration velocity and intensity of the electric fields. Typically the higher the voltage the higher the acceleration. Since it is desired to have maximum acceleration, methods must be employed to limit or eliminate unwanted ozone production.

DISCLOSURE OF INVENTION

Ion wind devices accelerate gas ions by applying differential high voltage electric fields between one or more emitters and a plurality of collectors (accelerators). The inventive method limits ozone production while simultaneously realizing incidents of high acceleration in such devices by varying the high voltage potential across the array of emitter(s) and collectors over time in such a manner as to generate a "wave effect" of airflow. Several alternative methods of varying the high voltage potential have proven successful in accomplishing this wave effect. One method, which may be referred to as a switching method, allows the positive emitter high voltage potential to operate at a reduced level (e.g., +6 KY) for a period of time (e.g., three seconds), and then switch to a higher potential (e.g., +8.5 KY) for another, and preferably shorter period of time (e.g., one second). The result is that at the lower potential (less ozone generating level) airflow is simultaneously reduced. However, when switched from the lower to the higher potential for one second higher airflow is momentarily achieved due to accelerated ion momentum. The overall average airflow is slightly higher than the linear three to one time ratio due to ion momentum transfer and resulting inertia from it.

An alternative method, which may be referred to as a ramping method, accomplishes the wave effect by use of an electronic circuit to generate a nonlinear sawtooth ramp driving voltage. Typical ramp duration would also be, e.g., four seconds, with the ending portion and trailing edge effecting the highest voltage state for approximately one second. In both the switching method and ramping method airflow velocities were varied typically from a low state of 300 feet per minute to a high state of 500 feet per minute. Subsequent ozone production levels varied from a low of 17 ppb for 3 seconds to a high of 50 ppb for less than one second. Overall average ozone production was less than 25 ppb. This represents an improvement over operating the same array at a steady state of 350 feet per minute and generating an average of 35 ppb ozone. Furthermore, the burst of 500 feet per minute of airflow improves perceptible operation of the ion wind device.

A further alternate method which also produces the wave effect may be referred to as a gate method, which is a gate voltage which switches either (or both) the positive high voltage to the emitter or the negative high voltage to the collector at timed intervals, such as 20 seconds off and then 20 seconds at the high voltage state. Finally, either the switching method, the ramping method or the gate method may be used in concert with each other or with other ozone control.

BEST MODE FOR CARRYING OUT THE INVENTION

Figure 1:
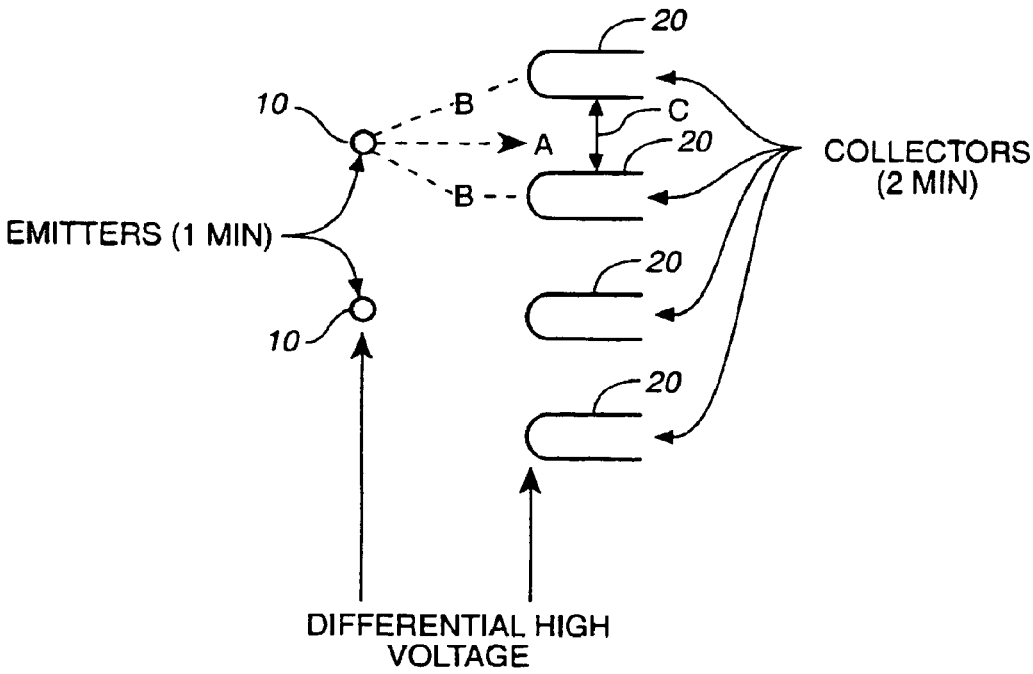
FIG. 1 is a schematic view of an emitter and collector (accelerator) array of an ion wind device.

FIG. 1 refers to a typical ion wind array such as described in Lee U.S. Pat. No. 4,789,801. The emitter or emitters 10 are typically constructed of 0.1 mm pure tungsten wire and may be of any length. The collectors (sometimes referred to as accelerators) 20 are typically constructed of any non corrosive conductive material such as copper, aluminum, stainless steel, or brass. The emitter 10 is always located opposite and at the center (A) of the opening of the collectors 20. The equidistant (B) of the emitter 10 to the leading edge (radius) of the collector 20 may vary depending upon desired operational effect, but is typically one inch. This is also true of the spacing (C) between the collectors 20.

The differential voltage applied across the emitter/collector array must be at least 6,500 volts in order to effect any substantial ion mobility and subsequent airflow. Typical configurations consist of applying a positive high voltage to the emitter 10 and a negative high voltage to the collector 20 to achieve a maximum differential voltage of 15,000 volts D.C. These voltage potentials may be reversed, however, when this is done an uneven plasma envelope is developed at the emitter source, which results in excessive corona noise and ozone production. Alternatively, the array may be driven by a single positive or single negative high voltage excitation source to the emitter 10 with the collectors 20 having a high impedance return to ground (to reduce load current and breakover arcing). Also, the excitation voltage may be modulated in ways taught U.S. Pat. No. 4,789,801 to achieve desired results.

Figure 2:
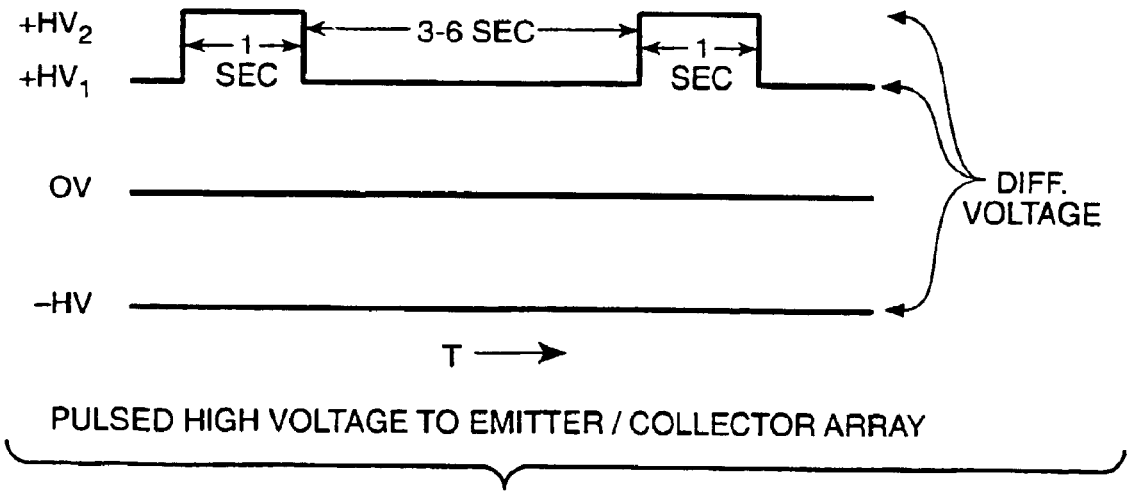
FIG. 2 is a schematic view of the switching method of varying the high voltage potential between the emitter(s) and collectors of this invention.

FIG. 2 is a schematic view of the switching method of this invention. This method provides a pulsed high voltage to the emitter/collector array, i.e., a high voltage excitation configuration to drive the array by switching from a lower-level positive high voltage state HV1 to a higher-level positive high voltage state HV2 at pre-determined time intervals, e.g., one second HV1 and three seconds HV2. It is not necessary to include the negative voltage reference –HV if the positive voltage is increased proportionally to achieve like airflow levels. Also, the voltage polarities may be reversed with minimal effect upon the airflow levels.

Figure 3:
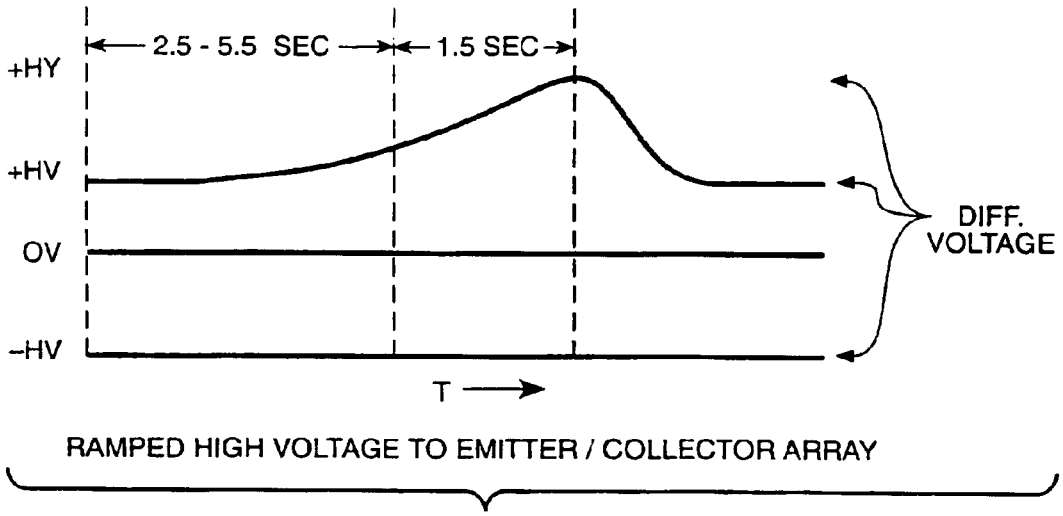
FIG. 3 is a schematic view of the ramping method of this invention.

FIG. 3 is a schematic view of the ramping method of this invention. This method provides a ramped high voltage to the emitter/collector array, i.e., a high voltage excitation configuration to drive the array with a voltage ramp, which changes in amplitude over a variable time interval. The low-level high voltage on time state may typically be as long as 5.5 seconds for minimal ozone production. Conversely, the low-level high voltage may be as short as 2.5 seconds for maximum desired ozone. The ramp up time is typically 1.5 seconds to create a differential voltage in excess of 14,000 volts. Actual time and amplitude may be varied for effect depending upon desired airflow and ozone levels.

Figure 4:
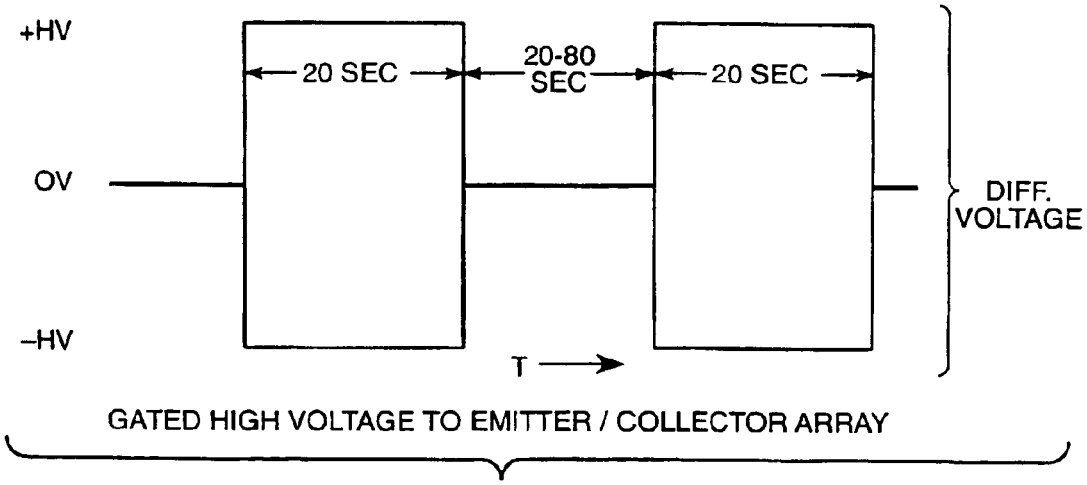
FIG. 4 is a schematic view of the gate method of this invention.

FIG. 4 is a schematic view of the gate method of this invention. This method provides a sequential high voltage to the emitter/collector array. i.e., a high voltage gating (or switching on/off) method whereby the differential high voltage applied to the array is turned from a zero state to a maximum high state at pre-determined intervals. The on/off timed states and differential amplitude may be varied for effect. For example, a 20-second on to 20 second off time and a differential high voltage level of 15,000 volts would be the maximum duty cycle and amplitude for airflow and ozone output. As in the switching and ramping methods, supra, it is not absolutely necessary to use a negative high voltage on the collector array if the voltage level is increased proportionally on the emitter array, since the airflow and ozone levels will change proportionally in like ambient conditions. However, a negative voltage applied to the collector array is usually used to improve contaminant collection, limit circuit cost and minimize corona arcing to neutral components located in the vicinity of the array housing.

What is claimed as invention is:

1. A method of reducing ozone production in ion wind devices, said method comprising the steps of:

providing an emitter;

providing a plurality of collectors;

positioning said collectors generally equidistant from said emitter to form an array;

providing a high voltage potential between said emitter and said collectors; and varying said high voltage potential over time to generate a wave effect of airflow and reduce total ozone production by switching said high voltage potential from a lower high voltage level for a first period of time, to a higher high voltage potential for a second period of time.

2. The method of reducing ozone production in ion wind devices of claim 1 wherein said lower high voltage level is approximately +6 KV, and said higher high voltage potential is approximately +8.5 KV.

3. The method of reducing ozone production in ion wind devices of claim 1 wherein said first period of time is greater than said second period of time.

4. The method of reducing ozone production in ion wind devices of claim 3 wherein said first period of time is approximately 3 seconds, and said second period of time is approximately 1 second.

5. A method of reducing ozone production in ion wind devices, said method comprising the steps of:

providing an emitter;

providing a plurality of collectors;

positioning said collectors generally equidistant from said emitter to form an array;

providing a high voltage potential between said emitter and said collectors; and varying said high voltage potential over time to generate a wave effect of airflow and reduce total ozone production by providing a nonlinear ramp driving voltage to said emitter/collector array, said nonlinear ramp driving voltage having a duration of approximately 4 seconds.

6. A method of reducing ozone production in ion wind devices, said method comprising the steps of:

providing an emitter;

providing a plurality of collectors;

positioning said collectors generally equidistant from said emitter to form an array;

providing a high voltage potential between said emitter and said collectors; and varying said high voltage potential over time to generate a wave effect of airflow and reduce total ozone production by providing a nonlinear ramp driving voltage to said emitter/collector array, said nonlinear ramp driving voltage having an ending portion and trailing edge effecting the highest voltage state for approximately 1 second.

7. A method of reducing ozone production in ion wind devices, said method comprising the steps of:

providing an emitter;

providing a plurality of collectors;

positioning said collectors generally equidistant from said emitter to form an array;

providing a high voltage potential between said emitter and said collectors; and varying said high voltage potential over time to generate a wave effect of airflow and reduce total ozone production by providing a gating voltage to said emitter/collector array.

8. The method of reducing ozone production in ion wind devices of claim 7 wherein said gating voltage is turned from a zero state to a maximum high state at predetermined time intervals.

9. A method of reducing ozone production in ion wind devices, said method comprising the steps of:

providing an emitter;

providing a plurality of collectors;

positioning said collectors generally equidistant from said emitter to form an array;

providing a high voltage potential of approximately +6 KV between said emitter and said collectors; and increasing said high voltage potential to approximately +8.5 KV briefly and periodically over time, wherein said high voltage potential is sustained for approximately 3 seconds and said increased high voltage potential is sustained for approximately 1 second to generate a wave effect of airflow, said wave effect comprising increased average airflow rate and reduced average ozone production.

10. A method of reducing ozone production in ion wind devices, said method comprising the steps of:

providing an emitter;

providing a plurality of collectors;

positioning said collectors generally equidistant from said emitter to form an array;

providing a high voltage potential between said emitter and said collectors; and increasing said high voltage potential briefly and periodically over time to generate a wave effect of airflow by providing a nonlinear ramp driving voltage to said emitter/collector array for a duration of approximately 4 seconds, said wave effect comprising increased average airflow rate and reduced average ozone production.

11. A method of reducing ozone production in ion wind devices, said method comprising the steps of:

providing an emitter;

providing a plurality of collectors;

positioning said collectors generally equidistant from said emitter to form an array:

providing a high voltage potential between said emitter and said collectors; and increasing said high voltage potential briefly and periodically over time to generate a wave effect of airflow by providing a nonlinear ramp driving voltage to said emitter/collector array, said nonlinear ramp driving voltage having an ending portion and trailing edge effecting the highest voltage state for approximately 1 second, said wave effect comprising increased average airflow rate and reduced average ozone production.

12. A method of reducing ozone production in ion wind devices, said method comprising the steps of:

providing an emitter;

providing a plurality of collectors;

positioning said collectors generally equidistant from said emitter to form an array;

providing a high voltage potential between said emitter and said collectors; and gating said high voltage potential from a zero state to a maximum high state at predetermined time intervals to generate a wave effect of airflow, said wave effect comprising increased average airflow rate and reduced average ozone production.

13. The method of reducing ozone production in ion wind devices of claim 12, wherein said maximum high state is sustained for a period of no more than 20 seconds.

14. The method of reducing ozone production in ion wind devices of claim 12, wherein said zero state is sustained for a period of approximately 20 seconds.

15. A method of increasing airflow in ion wind devices, said method comprising the steps of:

providing an emitter;

providing a plurality of collectors;

positioning said collectors generally equidistant from said emitter to form an array;

providing a high voltage potential between said emitter and said collectors; and varying said high voltage potential over a period of between one and twenty seconds time to generate a wave effect of increased airflow sensible to a user.

16. The method of increasing airflow in ion wind devices of claim 15 wherein said step of varying said high voltage potential over time comprises switching said high voltage potential from a lower high voltage level for a first period of time, to a higher high voltage potential for a second period of time.

17. The method of increasing airflow in ion wind devices of claim 16 wherein said lower high voltage level is approximately +6 Ky, and said higher high voltage potential is approximately +8.5 Ky.

18. The method of increasing airflow in ion wind devices of claim 16 wherein said first period of time is greater than said second period of time.

19. The method of increasing airflow in ion wind devices of claim 18 wherein said first period of time is approximately 3 seconds, and said second period of time is approximately 1 second.

20. The method of increasing airflow in ion wind devices of claim 15 wherein said step of varying said high voltage potential over time comprises providing a nonlinear ramp driving voltage to said emitter/collector array.

21. The method of increasing airflow in ion wind devices of claim 20 wherein said nonlinear ramp driving voltage has a duration of approximately 4 seconds.

22. The method of increasing airflow in ion wind devices of claim 20 wherein said nonlinear ramp driving voltage has an ending portion and trailing edge effecting the highest voltage state for approximately 1 second.

23. The method of increasing airflow in ion wind devices of claim 15 wherein said step of varying said high voltage potential over time comprises providing a gating voltage to said emitter/collector array.

24. The method of increasing airflow in ion wind devices of claim 23 wherein said gating voltage is turned from a zero state to a maximum high state at predetermined time intervals.

* * * * *